US005523006A

United States Patent [19]

Strumban

[11] Patent Number: 5,523,006

[45] Date of Patent: Jun. 4, 1996

[54] ULTRAFINE POWDER LUBRICANT

[75] Inventor: Emil E. Strumban, Oak Park, Mich.

[73] Assignee: Synmatix Corporation, Farmington Hills, Mich.

[21] Appl. No.: 373,120

[22] Filed: Jan. 17, 1995

[51] Int. Cl.[6] ..... C10M 103/04; C10M 125/04

[52] U.S. Cl. ..... 252/26; 420/457; 420/473; 420/475; 420/560; 75/255

[58] Field of Search ..... 252/9, 12, 18, 252/25, 26; 420/457, 473, 475, 560; 75/255; C10M 103/04, 125/04, 113/06

[56] References Cited

U.S. PATENT DOCUMENTS

| | | | |
|---|---|---|---|
| 2,117,106 | 5/1938 | Silliman | 420/473 |
| 3,994,697 | 11/1976 | Burke . | |
| 4,274,874 | 6/1981 | Obara et al. . | |
| 4,990,309 | 2/1991 | Miyafuji et al. | 420/473 |
| 5,302,450 | 4/1994 | Rao et al. . | |
| 5,397,485 | 3/1995 | Weichsel et al. | 252/25 |

OTHER PUBLICATIONS

"Single Crystal Metals Encapsulated in Carbon Nanoparticles", Science, vol. 259, Jan. 15, 1993, pp. 346–348.

"Cobalt–catalysed growth of carbon nanotubes with single–atomic–layer walls", Nature, vol. 363, Jun. 17, 1993.

*Primary Examiner*—Prince Willis, Jr.
*Assistant Examiner*—Cephia D. Toomer
*Attorney, Agent, or Firm*—Harness, Dickey & Pierce

[57] ABSTRACT

An ultrafine particle copper, tin, nickel, zinc lubricant with a surface area of from 5 to 70 $m^2/g$ and a particle size of from about 0.01 to about 0.5 μm. The powder dispersed in a carrier to form a dispersion stabilized by Brownian movement.

22 Claims, No Drawings

ULTRAFINE POWDER LUBRICANT

BACKGROUND OF THE INVENTION

The present invention relates generally to lubricants. In particular the present invention relates to a solid lubricant which comprises a copper-nickel-tin alloy ultra fine particles.

It is well-known that adding a solid lubricant such as powdery graphite or P.T.F.E. (Polytetrafluoroethylene), tungsten disulfide, molybdenum disulfide, etc. to a working surface leads to enhancing the lubricating properties of the surface; such as preventing of scoring of the contacting surface due to frictional heat and improvement of wear resistance at high temperatures and under high pressures.

Coupled with a wide diversity in the compositions themselves, various different techniques have been invoked in distributing and applying the lubricant to the areas to be treated. Such techniques have conventionally included incorporation of the lubricating material in various physical forms including oils and greases, as well as oil and grease compositions in which solids such as graphite, molybdenum disulfide, P.T.F.E., etc. have been dispersed or suspended. The benefits of solid particle lubricant additives are based on the so called cushioning effect i.e., the solid particles act as a cushion between sliding metal surfaces.

However, there are several problems associated with the use of the above mentioned solid lubricants. For instance when a sulphur compound is added, the additive and the contacting surface chemically react to the frictional heat and induce oxidation and corrosion of the contacting surface. This results in an increase in wear of the contacting surface. When an organic high molecular weight material such as P.T.F.E. is used, the product has inferior heat conductivity and heat stability.

Furthermore, when a powdery graphite is used, it is known that the lubricating properties deteriorate unless a water absorbing layer is contained in the thin molecular surface. On the other-hand, corrosion of the metal surface is induced in the presence of water.

Also, the preparation of stable dispersions of the solid lubricants mentioned above through chemical stabilization is a very complex problem. Moreover, the dispersions achieved by the chemical stabilization methods are short-lived. Upon standing for a short period of time, the particles settle due to gravitation and may even develop what is called a "hard settle", i.e., the particles cannot be redispersed.

A method of applying a high lubricity film as a friction-reducing surface coating formed by means of disintegrating of a pellet consisting of an intimate mixture of a finally divided powdery tin-lead type alloy and a molybdenum disulfide is described in U.S. Pat. No. 3,994,697 to Burke. However this solid lubricant is distributed by fuel of an internal combustion engine and can be delivered only to the fuel contacting parts of the engine. Furthermore the requirement for the pellet to be susceptible to abrasion within the fuel tank makes the disintegration process irregular and dependent upon many uncontrolled parameters.

A fine powder alloy used for an oil-impregnated bearing which contains a solid lubricant and phosphorus having a high reactivity with said solid lubricant and high oil content is disclosed in U.S. Pat. No. 4,274,874 to, Obara et al. This patent teaches sintering of a copper tin type powder alloy with 20 to 80 μm molybdenum or tungsten disulfide particles acting as a solid lubricant. However, this patent is for production of a bearing material impregnant with lubricant oil that reduces the friction at the metal-to metal contact portion between a rotating shaft and the bearing rather than for a formation of a solid lubricant coating film for surface boundary lubrication.

Therefore it is a goal in the art to provide a more stable dispersion of particle type lubricants which do not suffer from the limitations noted above.

It is also goal in the present invention to provide an effective solid lubricant which acts as a solid lubricant and as a surface bonding plating.

It is also a goal in the present invention to provide a lubricant which is not appreciably affected by high temperatures or high pressures and is more advanced than conventional solid and liquid lubricants.

SUMMARY OF THE INVENTION

In accordance with these goals there is provided in the present invention a lubricating composition which includes a copper-nickel-tin alloy which alloy may also include other metals such as zinc which do not affect the basic and novel characteristics of the present invention set forth herein. The alloy is an ultrafine metal powder having a particle size of from about 0.01 to about 0.5 μms with a specific surface area of from about 5 to about 70 meter$^2$/gram (m$^2$/g). The alloy may be dispersed in a suitable carrier or used as a dry lubricant.

The present invention overcomes many of the problems which exist in the prior art. The novelty of the solid lubricant of the present invention lies not only in its form and in its composition, but also in the manner in which the lubricant forms a stable suspension in the carrier liquid and accordingly is delivered to the areas where it is to function. More specifically, the invention in a preferred embodiment, is an ultra-fine powder metal alloy. This powder is dispersed into a carrier liquid and forms a stable colloidal or partly colloidal suspension stabilized by Brownian movement. Thus, the particles effectively act as a solid lubricant and as a surface bonding plating. The lubricant is not essentially affected by high temperatures or high pressures and in this sense, is highly advanced relative to the more conventional solid and liquid lubricants.

It is therefore, an aim of the present invention to provide both a new type of lubricating composition and a reliable method of keeping this material in dispersion in a carrier liquid by forming a colloidal or at least partly colloidal suspension stabilized by Brownian movement.

It is a principle object of the invention to provide a lubricating composition in an improved physical form constituting an ultrafine powder, which can be easily dispersed in a liquid carrier.

It is a related object of the invention to provide an improved lubricating composition which operates to deposit a highly effective lubricating film as a low-friction interface between moving metal surfaces. It is an important feature of the invention that the solid lubricant is dispersed in an ultrafine particulate form and these particles are delivered directly to lubrication requiring surfaces to produce a highly adherent pressure and corrosion-resistant film of solid lubricant as a wear deterring anti-friction coating.

Yet another object of the invention is to provide an oil carried composition which is effective to fill in and to smooth various defects on the friction surfaces, which have become worn, pitted or eroded.

Still another object of the invention is to provide an ultrafine powder that being dispersed in a liquid carrier will give a homogeneous distribution of fine particulate metallic elements effective to provide a plating like coating of wear subjected surfaces.

It is an important feature of the solid lubricant of the invention that it is stable against the harmful effects of high temperatures and pressures which ordinarily make liquid lubricants ineffective.

Still another important feature of the powder solid lubricant of the invention is that it is effective over an extended period of time, the lubricating particles are time sustained and are a function only of the concentration of the particles in the suspension.

It is another feature of the composition of the invention to provide an effective fluid sealing coating on opposed sliding surface metal elements.

Other features and advantages of the present invention will become apparent to those skilled in the art upon review of the Description of the Preferred Embodiments, the Examples and the Claims appended hereto.

DESCRIPTION OF THE PREFERRED EMBODIMENTS

In its broad aspects, the present invention includes a particulate metal alloy lubricant which has particle sizes of from about 0.01 to about 0.5 μms with preferred size being from about 0.01 to 0.1 μms and a specific surface area of from about 5 to about 70 $m^2/g$. Preferably, the metal powder is dispersed in a liquid carrier forming at least a partly colloidal dispersion and preferably a fully colloidal dispersion wherein Brownian movement is utilized for stabilizing the dispersion of the particulate alloy.

The specific surface area of the particulate metal alloy of the present invention is generally of from about 5 to about 70 $m^2/g$, typically from about 10 to about 50 $m^2/g$ and preferably of from about 10 to about 30 $m^2/g$. In its broad aspects alloys of the present invention have the formula:

$$Cu_xNi_ySn_zZn_{1-x-y-z}$$

wherein $0<x<1$ $0<y<1$ $0<z<1$ and $x+y+z\leqq 1$ wherein x,y, and z are the mole fractions of the corresponding elements comprised in the ultrafine powder alloy of the present invention.

A typical particulate metal alloy of the present invention is a nickel-copper-tin alloy having from about 20 weight % to about 90 weight %, copper from about at 0.1 weight % to about 70 weight % nickel; and from about 10 weight % to about 60 weight % tin. Zinc may also be included but is not essential to the alloy. Thus, zinc can be found in the alloy in amounts of from about 0 to about 5 weight %. A preferred particulate metal alloy of the present invention is a copper nickel tin zinc alloy which includes from about 84 to 86 weight % copper; from about 2.5 to 3.5 weight % nickel; from about 11 to about 13 weight % tin; and from about 0.05 to about 0.2 weight % zinc. A particularly preferred alloy is as follows: Copper, 85.0 weight %; nickel, 2.9 weight %; tin, 12.0 weight %; and zinc, 0.1 weight %.

The particulate metal alloy of the present invention is preferably made wherein the ultrafine powder of copper-nickel-tin-zinc is a product of plasma assisted evaporation of the alloy components and thereafter a high rate quenching of the mixture of the alloy chemical element vapors and plasma stream which leads to formation of ultrafine particles of copper-nickel-tin-zinc alloy which have the specific surface area of from 5 to about 70 $m^2/g$ and particle sizes of from 0.01 to about 0.5 μms.

Such a process is disclosed in my patent application entitled "Method for making Carbon-encapsulated Ultrafine Metal Particles" to Strumban et al. filed on Jan. 17, 1995, U.S. Ser. No.08/373,631 which is incorporated herein by reference. Of course, in the present application it is not necessary to use carbon atmosphere for encapsulation of particles. Thus, the process of the above patent application would be modified to be accomplished in an entirely inert atmosphere.

As stated above in a preferred embodiment the particulate metal alloy is suspended in a liquid carrier and forms at least a partly colloidal dispersion and preferably a fully colloidal dispersion. Suitable carriers include lubricant oils, soap greases, and insulating fluids with particularly preferred liquid carriers being selected from the group comprising mineral oils, animal oils, vegetable oils, synthetic oils, soap greases, hydrocarbon fluids and mixtures thereof. Generally the ultrafine powder alloy of the present invention is added to the carrier in amounts of from about 0.1 to about 30% by volume with preferred amounts typically in the range of from about 0.1 to about 10% by volume.

In order to provide for better fluidity in the suspension suitable surfactants can be added to the liquid carrier in the amounts of from about 0.1% to about 5% by weight and preferably of from about 0.1 to about 1% by weight of the ultrafine particulate alloy dispersed. Suitable surfactants include those such as anionic, non-ionic and cationic surfactants. Suitable surfactants include those such as the following commercially available surfactants: Emcol 4501, Witconate P-1059, Disperse-AYD 9100, TLA-510A, and the like.

The ultrafine powder lubricant dispersion is self-stabilized due to the effect of Brownian movement in liquids—the irregular motion of a body arising from the thermal motion of the molecules of the medium in which the body is immersed. That provides a stable suspension of the lubricant particles in a liquid carrier.

The fact that the ultrafine particles of the present invention are comparable in size, with the molecules of the liquid carrier they are dispersed in, increases the influence of Brownian movement effect in the suspension at least by a factor of $10^2$ that prevents particles from precipitation out of the suspension. This means that working life of the suspensions, utilizing ultrafine particles of the present invention, is at least about 100 times longer than that for suspensions which include conventional powders. This provides a great advantage over prior art powder lubricants used in suspensions. Thus, the ultrafine powder lubricant of the present invention provides a product with improved consistency and homogeneity during use.

Additionally, because of the well developed surface of the lubricant particles, of the present invention, each particle contains a high concentration of asperities. This provides for improved physical adherence and gap filling of surface abrasions or the like on the surface to be lubricated by the ultrafine powder lubricant of the present invention.

The ultrafine powder lubricant of the present invention prior or during dispersing in a liquid carrier can be encapsulated in various synthetic resins such as silicone resins, methacrylate resins, acrylic resins, synthetic rubber, polyethylenes, etc.

The dispersion of the present ultrafine solid lubricant into the liquid carrier may be carried out by a conventional method. For instance, the particulate lubricant may be added to an appropriate liquid carrier suitable for the intended use and the mixture is agitated. If necessary, the resulting mixture is added to other powder additives and after that is subjected to various treatments such as heating, cooling or processing, according to conventional methods, to give the desired product. Other additives used may include solid lubricants with layered crystal structures and soft metals or the like which are known in the art.

In the present invention the main purpose of the ultrafine powder lubricant is to form a stable, protecting low friction coating on the surface to be lubricated. It is not necessary that the lubricant be applied, to the surface subjected to friction, in the form of a stable suspension. The lubricant can be also applied to a surface in any manner such as spraying, rubbing, painting, dipping or in any other conventional manner.

Further understanding of the present invention will be gleaned with reference to the following examples which are provided herein for purposes of illustration and not limitation.

EXAMPLE I

A polyethylene container of 1 liter of volume and opening of 4 cm was used. The filling level of the container was 100%.

A lubricant suspension is prepared as set forth below in Table I:

TABLE I

| CONSTITUENT DESCRIPTION | AMOUNT (wt. %) | |
|---|---|---|
| Carrier | 98.0 | Mineral oil (Eastern 2828) Viscosity-30 cSt (40° C.) |
| Powder alloy | 1.1 | $Cu_{30}$ $Ni_{67}$ $Sn_{2.5}$ $Zn_{0.5}$ average particle size ≅ 50 nm |
| Surfactant | 0.9 | Witconate P-1059 (Produced by Witco Corporation). |

The filled container was left standing for a certain period of time, set forth below in Table II. After the storage time has expired, the ratio of the clear liquid layer height above the suspension to the initial suspension column height was measured. The sedimentation behavior of the suspension is expressed as "percentage of precipitation". Consequently, the expression 0% of precipitation means that a clear liquid phase above the suspension was not formed at all (i.e. the particulate alloy remains 100% suspended).

The consistency of the precipitated particles possibly formed at the end of the storage time was determined by means of a test of suspension pouring from the container. On the basis of the behavior of the suspension and the precipitated particles, the following evaluation marks were used:

$P_1$=the container is completely emptied within two minute time, with few noticeable precipitated particles remaining at the bottom;

$P_2$=the container is completely emptied within a two minute time, with a thin noncontinuous film of particles of soft consistency and easy to be suspended again remaining at the bottom;

$P_3$=the container is completely emptied within a two minute time, with a continuous film of particles of soft consistency and easy to be suspended again remaining at the bottom. The results are set forth below in Table II.

TABLE II

| | After 10 days | After 20 days | After 30 days |
|---|---|---|---|
| Precipitation percentage: | 5.5% | 8.0 | 9.5 |
| Particles consistency | | | |
| P1: | Yes | No | No |
| P2: | No | Yes | No |
| P3: | No | No | Yes |

As can be seen by these results the particles remain in suspension for extremely long periods of time.

EXAMPLE II

The lubricant suspension of Example I was tested using pin-on-disk machine. Essentially, the test geometry was a hemispherical-tipped (4.4 mm radius) pin-on-disk configuration with the stationary pin sliding over the same track on the rotating disk. The mean peripheral velocity was 0.13 m/s and the average load was 3500 kN/m$^2$. The results of these measurements are indicated in Table 3.

TABLE 3

| Lubricant | Co-efficient | PV factor | Vel-ocity | Wear |
|---|---|---|---|---|
| (composit-ion, wt. %) | of friction | (kN/m$^2$ × m/s) | (m/s) | |
| $Cu_{30}$ $Ni_{67}Sn_{2.5}$ $Zn_{0.5}$ | 0.12 | 45.50 | 0.13 | 8 |

As shown in tables 2 and 3 the lubricating composition of the present invention not only shows a very high stability being dispersed in mineral oil, but also exhibits good wearing performance with a low coefficient of friction under the elevated service conditions.

EXAMPLE III

Particulate alloys of the present invention are prepared with ranges of Copper of from 20 to 90 weight %; Nickel of from 0.1 to about 70 weight %; tin from 10 to about 60 weight % and zinc from 0.1 to 5 weight % with particle sizes ranging from 0.01 to 0.5 μm and surface areas of from 5 m$^2$/g to 70 m$^2$/g. The particles are found to stabilize well in the mineral oil suspensions and show very good lubricity properties.

It will be readily appreciated by those skilled in the art that the present invention can be practiced other than as specifically stated. Thus, the invention may be subject to modification, variation and change without departing from the proper scope and fair meaning of the accompanying claims.

What is claimed:

1. A lubricating system comprising a particulate metal alloy selected from the group consisting of copper-nickel-tin, copper-nickel-tin-zinc and mixtures thereof and a carrier, said particulate metal alloy having a particle size of from about 0.01 to about 0.5 μm and a surface area of from about 5 m$^2$/g to about 70 m$^2$/g, said particulate metal alloy being dispersed in said carrier in an amount of from about 0.1 to about 30% by volume.

2. The lubricating system of claim 1 wherein the particulate metal alloy is an alloy comprising copper, nickel and tin and having a surface area of from about 10 to about 50m$^2$/g.

3. The lubricating system of claim 1 wherein the particulate metal alloy has a specific surface area of from about 10 to about 30 $m^2/g$.

4. The lubricating system of claim 1 wherein said carrier is selected from the group consisting of lubricating oils and greases.

5. The lubricating system of claim 1 wherein the particulate metal alloy has the formula:

$$Cu_x Ni_y Sn_z Zn_{1-x-y-z}$$

wherein $0<x<1$ $0<y<1$ $0<z<1$ $x+y+z \leqq 1$ wherein x, y, and z are the mole fraction of the corresponding chemical elements comprised in the alloy.

6. The lubricating system of claim 1 further comprising a surfactant selected from the group consisting of anionic surfactants, non-ionic surfactants, cationic surfactants and mixtures thereof.

7. The lubricating system of claim 6 wherein said surfactant comprises from about 0.1 to about 5% of the weight of the particulate metal alloy.

8. The lubricating system of claim 1 wherein the particulate metal alloy is encapsulated in a synthetic resin.

9. The lubricating system of claim 8 wherein said synthetic resin is selected from the group consisting of silicone resins, methacrylate resins, acrylic resins, synthetic rubber, polyethylene and mixtures thereof.

10. A lubricating system comprising a liquid carrier; and from about 0.1 to about 30% by volume of a particulate copper-nickel-tin-zinc alloy having a particle size of from about 0.01 to about 0.5 μms and a surface area of from about 5 to about 70 $m^2/g$ whereby said lubricating system is stabilized by Brownian movement for forming an at least partly colloidal suspension.

11. The lubricating system of claim 10 wherein said metal alloy comprises from about 20 to about 90 weight % copper, from about 0.1 to about 70 weight % Ni from about 10 to about 60 weight % tin and from about 0.1 to about 5 weight % zinc.

12. The lubricating system of claim 11 wherein said liquid carrier is selected from the group consisting of mineral oils, animal oils, vegetable oils, soap greases, synthetic oils, and mixtures thereof.

13. The lubricating system of claim 11 further comprising a surfactant in an amount of from about 0.1 to about 5% of the weight of the particulate copper-nickel-tin-zinc alloy, said surfactant selected from the group consisting of anionic surfactants, cationic surfactants, non-ionic surfactants, and mixtures thereof.

14. The lubricating system of claim 11 wherein said particulate metal alloy is produced by plasma assisted evaporation of the alloy at high rate quenching of a metal vapor/plasma stream mixture.

15. The lubricating system of claim 11 wherein the particulate alloy is encapsulated in a synthetic resin.

16. The lubricating system of claim 11 wherein the copper nickel-tin zinc has the formula:

$$Cu_x Ni_y Sn_z Zn_{1-x-y-z}$$

wherein $0<x<1$ $0<y<1$ $0<z<1$ $x+y+z \leqq 1$ wherein x, y, and z are the mole fraction of the corresponding chemical elements comprised in the alloy.

17. A powder lubricant comprising a copper-nickel-tin-zinc alloy having a mean particle size from about 0.01 to about 0.5 μms and a surface area of from about 5 to about 70 $m^2/g$.

18. The powder lubricant of claim 17 wherein the copper-nickel-tin-zinc alloy has the formula:

$$Cu_x Ni_y Sn_z Zn_{1-x-y-z}$$

wherein $0<x<1$ $0<y<1$ $0<z<1$ $x+y+z \leqq 1$ wherein x, y, and z are the mole fraction of the corresponding chemical elements comprised in the alloy.

19. The powder lubricant of claim 18 wherein the alloy consists essentially of from about 20 to about 90 weight % copper; from about 0.1 to about 70 weight % nickel; from about 10 to about 60 weight % tin and from about 0.1 to about 5 weight % zinc.

20. The powder lubricant alloy of claim 18 wherein the particle size is from about 0.01 to about 0.1 μms.

21. The powder lubricant of claim 20 wherein the alloy consists essentially of from about 84 to about 86 weight % copper; from about 2.5 to about 3.5 weight % nickel, from about 11 to about 13 weight % tin and from about 0.05 to about 0.2 weight % zinc.

22. The powder lubricant of claim 21 wherein the alloy consists of 85 weight % copper; 2.9 weight % nickel; 12.0 weight % tin and 0.1 weight % zinc.

* * * * *

UNITED STATES PATENT AND TRADEMARK OFFICE

CERTIFICATE OF CORRECTION

PATENT NO. : 5,523,006

DATED : June 4, 1996

INVENTOR(S) : Emil E. Strumban

It is certified that error appears in the above-indentified patent and that said Letters Patent is hereby corrected as shown below:

Column 1, Line 25, "effect i.e.," should be --effect, i.e.,--.

Column 2, Line 1, "metal-to metal" should be --metal-to-metal--.

Column 3, Lines 58-59, "copper nickel tin zinc" should be --copper-nickel-tin-zinc".

Column 4, Line 8, "making" should be --Making--.

Column 4, Line 8, "Carbon-encapsulated" should be --Carbon-Encapsulated--.

Column 5, Line 45, delete "has".

Column 5, Line 51, "(i.e." should be --i.e.,--.

Column 5, Line 58, after "within" insert --a--.

Column 6, Line 24, "Table 3" should be --Table III--.

Column 6, Line 26, "TABLE 3" should be --TABLE III--.

Column 6, Line 34, "tables 2 and 3" should be --Tables II and III--.

Column 7, Line 41, Claim 11, "Ni" should be --nickel,--.

UNITED STATES PATENT AND TRADEMARK OFFICE

CERTIFICATE OF CORRECTION

PATENT NO. : 5,523,006

DATED : June 4, 1996

INVENTOR(S) : Emil E. Strumban

It is certified that error appears in the above-indentified patent and that said Letters Patent is hereby corrected as shown below:

Column 8, Line 6, Claim 15, after "particulate" insert --metal--.

Column 8, Lines 7-8, Claim 16, "copper nickel-tin zinc" should be --copper-nickel-tin-zinc--.

Signed and Sealed this

Twenty-fifth Day of February, 1997

*Attest:*

*Attesting Officer*

BRUCE LEHMAN

*Commissioner of Patents and Trademarks*